United States Patent [19]

Todokoro

[11] Patent Number: 4,790,790

[45] Date of Patent: Dec. 13, 1988

[54] TOY MUSICAL INSTRUMENT

[75] Inventor: Masatoshi Todokoro, Tokyo, Japan

[73] Assignee: Staff Co., Ltd., Tokyo, Japan

[21] Appl. No.: 138,334

[22] Filed: Dec. 28, 1987

[30] Foreign Application Priority Data

Sep. 4, 1987 [JP] Japan ..... 62-134597[U]

[51] Int. Cl.[4] ..... A63H 5/00

[52] U.S. Cl. ..... 446/408; 446/209; 446/418

[58] Field of Search ..... 446/202, 203, 204, 206, 446/207, 208, 209, 408; D17/2, 4; D21/64; 84/170

[56] References Cited

U.S. PATENT DOCUMENTS

| | | | |
|---|---|---|---|
| 26,434 | 10/1904 | Winter | 84/170 |
| D. 158,632 | 5/1950 | Zimmerman | D21/64 |
| D. 162,190 | 2/1951 | Lippman | D21/64 |
| D. 269,018 | 5/1983 | Appel et al. | D21/64 |
| 366,355 | 7/1887 | Travis | 84/170 |
| 2,396,250 | 3/1946 | Clayman | 446/209 |
| 3,595,121 | 7/1971 | Magers | 84/402 |

*Primary Examiner*—Robert A. Hafer
*Assistant Examiner*—Michael Brown
*Attorney, Agent, or Firm*—George B. Oujevolk

[57] ABSTRACT

A toy musical instrument comprising a toy body, an imitation mouthpiece projecting outward from one side portion of the wall of said toy body, formed similarly to a mouthpiece of a trumpet and adapted to generate an imitation sound of a trumpet when a blast is given on the imitation mouthpiece with the imitation mouthpiece held in the mouth, an imitation bell, from which the imitation sound of a trumpet is sent out, projecting outward from the other side portion of the wall of the toy body, and some other kinds of imitation musical instruments provided on the remaining portion of the wall of the toy body, which include imitation castanets formed similarly to castanets and assembled so that an imitation sound of castanets occurs when they are beaten, an imitation piano formed similarly to a keyboard of a piano and assembled so that an imitation sound of a piano occurs when it is beaten, an imitation drum formed similarly to a parchment of a drum and assembled so that an imitation sound of a drum occurs when it is beaten, and an imitation xylophone formed similarly to a keyboard of a xylophone and assembled so that an imitation sound of a xylophone occurs when it is beaten.

3 Claims, 3 Drawing Sheets

TOY MUSICAL INSTRUMENT

BACKGROUND OF THE INVENTION

1. Field of the Invention

This invention relates to a toy musical instrument, and more particularly to a compound toy musical instrument.

2. Prior Art

The conventional toy musical instruments include toy musical instruments each of which consists of a single imitation musical instrument, but do not a compound toy musical instrument which consists of a toy body, and molded, imitative characteristic portions fixed thereto of a plurality of different kinds of musical instruments.

OBJECT OF THE INVENTION

A first object of the present invention is to provide a compound toy musical instrument consisting of a toy body, and molded, imitative characteristic portions fixed thereto of a plurality of different kinds of musical instruments.

A second object of the present invention is to provide a toy musical instrument having a single toy body and capable of being played by performing on a trumpet portion, a castanets portion, a piano portion, a drum portion and a xylophone portion separately or not less than two suitably selected portions in concert.

These objects and features of the invention will be understood more clarly when the following statement is considered with reference to the accompanying drawings which illustrate an embodiment of this invention.

BRIEF DESCRIPTION OF THE DRAWINGS

The accompanying drawings show an embodiment of the present invention, wherein.

DETAILED DESCRIPTION OF THE INVENTION

Figure 1:
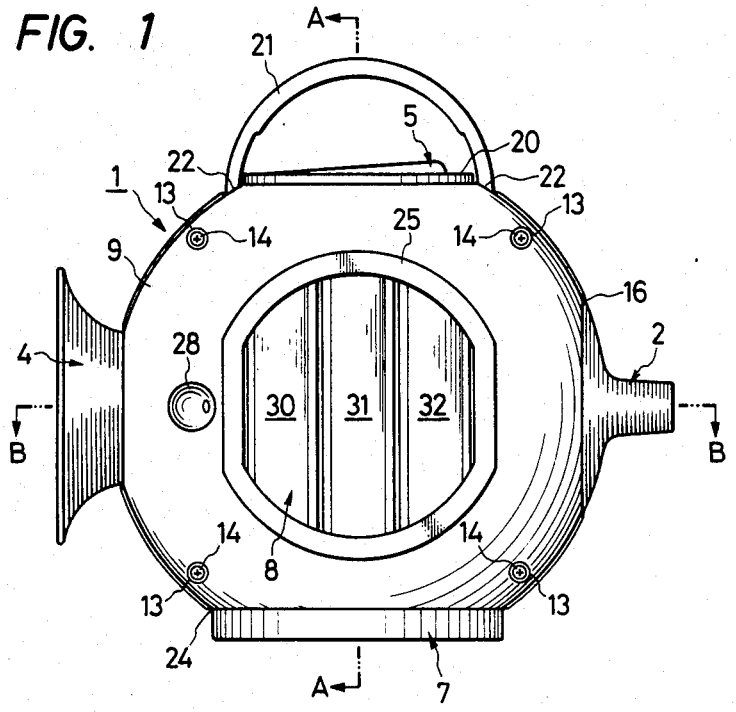
FIG. 1 is a front elevation of a toy musical instrument.
Figure 2:
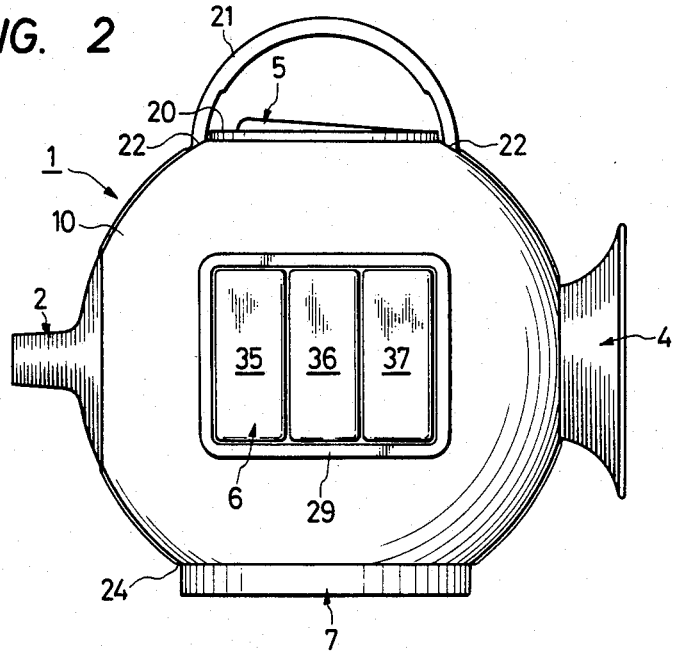
FIG. 2 is a rear elevation.
Figure 3:
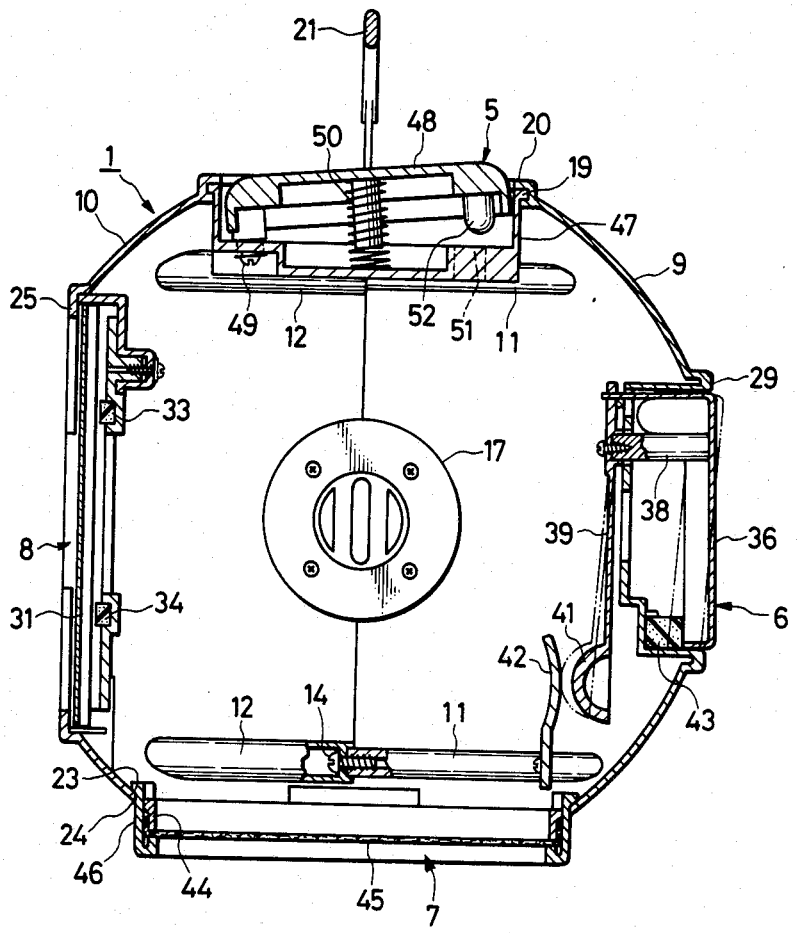
FIG. 3 is a sectional view taken along the line A—A in FIG. 1.
Figure 4:
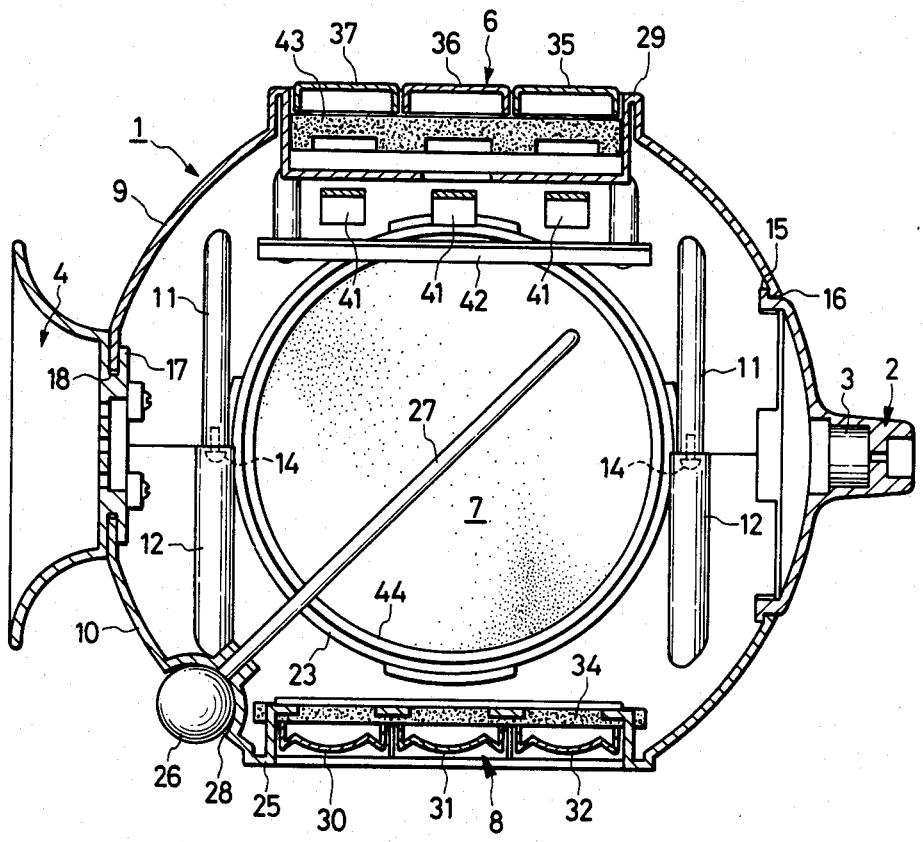
FIG. 4 is a sectional view taken along the line B—B in FIG. 1.

The present invention will now be described in detail with reference to the drawings. Reference numeral 1 denotes a spherically-formed toy body, 2 an imitation mouthpiece of a trumpet, which is fixed to a side surface of the toy body 1 so as to project outward therefrom, 3 a sound generating member provided in the interior of the imitation mouthpiece 2 and formed so that an imitation sound of a trumpet occurs when a blast is given on the mouthpiece 2 with the mouthpiece 2 held in the mouth, and 4 an imitation bell, from which the imitation sound of a trumpet is sent out, of a trumpet, the bell 4 being fixed to the side surface of the toy body 1 which is on the opposite side of the mouthpiece 2, so as to project outward therefrom. The remaining portion of the outer surface of the toy body 1 is provided thereon with imitation castanets 5 assembled so that the imitation sound of castanets occurs when they are beaten, an imitation piano 6 shaped like a keyboard of a piano and assembled so that an imitation sound of a piano occurs when it is beaten, an imitation drum 7 shaped like a parchment portion of a drum and assembled so that an imitation sound of a drum occurs when it is beaten, and an imitation xylophone 8 shaped like a keyboard of a xylophone and assembled so that an imitation sound of a xylophone occurs when it is beaten.

EMBODIMENT

A toy body 1 is assembled by putting together a pair of walls 9, 10 molded hemispherically out of, for example, a plastic, fitting the free end portions of a plurality of larger-diameter pipes 12, which are formed integrally with and project from the inner surface of one wall 10, around those of a plurality of smaller-diameter pipes 11, which are formed integrally with and project from the portions of the inner surface of the other wall 9 which are opposed to the pipes 12, inserting screws 14 into the openings 13 made in the wall 10 so as to be communicated with the larger-diameter pipes 12, and driving these screws 14 into engagement with the relative smaller-diameter pipes 11. The toy body 1 is provided in its right side portion in FIG. 1 with an opened edge 16 holding a front locking edge 15 of the imitation mouthpiece 2, and in its left side portion with an opened edge 18 holding a rear locking edge 17 of the imitation bell 4. The imitation castanets 5 is fitted in the upper portion of the toy body 1, and this portion of the toy body 1 is provided with an opened edge 20 holding a locking edge 19 of the imitation castanets 5, and opened edges 22, 22 holding both end portions of a handle 21. The lower portion of the toy body 1 is provided with an opened edge 24 holding a locking edge 23 of the imitation drum 7, and the front portion of the toy body 1 frame 25 in which the imitation xylophone 8 is wholly fitted, and an opening 28 into which a rod 27 having a spherical body 26 at one end thereof is withdrawably inserted. The rear portion of the toy body 1 is provided with a frame 29 in which the imitation piano 6 is wholly fitted. The imitation xylophone 8 is assembled so that three metal pieces 30, 31, 32 shaped so as to form, for example, an imitation keyboard of a xylophone and painted red, blue and yellow are received by cushion members 33, 34. The imitation piano 6 is assembled as follows. One end portion of each of connector bars 39 is joined by a screw 40 to the inner end portion of each of shafts 38 each of which projects into the interior of the toy body 1 from one end portion of corresponding plate out of three plates 35, 36, 37 shaped so as to form, for example, an imitation keyboard of a piano and painted red, blue and yellow. The connector bars 39 are provided at the other end portion of each thereof with a hammer 41, and a sound generator 42 is supported in a position opposed to these hammers 41, the other end portion of each of the plates 35, 36, 37 being received by a cushion member 43. The imitation drum 7 is assembled by, for example, enclosing an inner frame 44 with a thin cover member 45 having a high tensile strength, and fitting an outer frame 46 around the inner frame 44 from the outer side of the cover member 45. The imitation castanets 5 is assembled by, for example, fitting a cover 48 in a vessel 47, connecting one end portion of the cover 48 pivotably to the bottom portion of the vessel 47 with a screw 49, providing a spring 50 between the central portion of the cover 48 and that of the vessel 47, and forming a hammer 52, by which a sound generator 51 provided on the bottom portion of the vessel 47 is beaten against the resilient force of the spring 50, on the inner surface of the other end portion of the cover 48.

The toy body 1 may be formed in various shapes in addition to a spherical shape.

Since this invention is constructed as described above, the imitations, which are provided on a single toy body, of five kinds of musical instruments including a trumpet, castanets, a piano, a drum and a xylophone and popular among children can be selected freely and played separately with the toy suspended at the handle or placed on a table. The imitation castanets, piano, drum and xylophone can also be selected suitably and played in concert with the imitation trumpet with the imitation mouthpiece held in the mouth. Especially, when the toy body is formed spherically, this toy musical instrument can also be used as a ball, one of sporting goods. Thus, the present invention can provide an interesting toy musical instrument.

What is claimed is:

1. A toy musical instrument comprising:

(a) a toy body having one and the other side portions;

(b) an imitation mouthpiece projecting outward from the one side portion, formed similarly to a mouthpiece of a trumpet and having means to generate an imitation sound of a trumpet when a blast is given on said imitation mouthpiece with said imitation mouthpiece held in the mouth;

(c) an imitation bell, from which the imitation sound of a trumpet is sent out, projecting outward from said other side portion;

(d) other kinds of imitation musical instruments provided on the remaining portion of the body which include imitation castanets formed similarly to castanets and having means providing an imitation sound of castanets when they are beaten, an imitation piano formed similarly to a keyboard of a piano and having means providing the sound of a piano when it is beaten, an imitation drum formed similarly to a parchment of a drum and having means providing an imitation sound of a drum occurs when it is beaten, and an imitation xylophone formed similarly to a keyboard of a xylophone and having means providing an imitation sound of a xylophone when it is beaten, said imitation castanets being formed by fitting a vessel in said toy body, putting a cover includes a central portion and an inner surface on said vessel, pivotably connecting one end portion of said cover to the bottom portion of said vessel, providing a spring between the central portion of the inner surface of said cover and that of the bottom portion of said vessel, and providing the other end portion of said cover with a hammer projection by which a section acting as a sound generator set in the bottom portion of said vessel is beaten by said projection.

2. A toy musical instrument according to claim 1, wherein said imitation drum is formed by enclosing an inner frame with a thin cover having a high tensile strength, fitting an outer frame around said inner frame from the outer side of said cover, and providing said outer frame with a locking edge to be held in an opened edge provided in said toy body.

3. A toy musical instrument according to claim 1, wherein said imitation piano is formed by fitting three plates in said toy body, projecting a shaft from one end portion of each of said plates into the interior of said toy body, joining one end portion of each of connector bars to the inner end of the relative shaft, providing the other end of each of said connector bar with a hammer, setting a sound generator in a position opposed to said hammers, and receiving the other end portion of each of said plates by a cushion member.

* * * * *